US006001310A

United States Patent [19]

Shaffer et al.

[11] Patent Number: 6,001,310

[45] Date of Patent: Dec. 14, 1999

[54] PLIABLE CENTRIFUGE TUBE ARRAY

[76] Inventors: John V. Shaffer, 14602 Keeneland Cir., Gathersburg; Richard Braverman, 9516 Kentstone Dr., Bethesda, both of Md. 20817

[21] Appl. No.: 08/948,776

[22] Filed: Oct. 10, 1997

Related U.S. Application Data

[60] Provisional application No. 60/028,283, Oct. 11, 1996.

[51] Int. Cl.[6] ..... B01L 3/14

[52] U.S. Cl. ..... 422/102; 494/85; 494/16; 422/104

[58] Field of Search ..... 422/99, 102, 104, 422/72; 494/21, 16, 20, 85

[56] References Cited

U.S. PATENT DOCUMENTS

| | | | |
|---|---|---|---|
| 2,878,994 | 3/1959 | Anderson | 494/10 |
| 3,050,239 | 8/1962 | Williams, Jr. . | |
| 3,679,130 | 7/1972 | Mayo et al. . | |
| 3,709,429 | 1/1973 | McKenzie et al. . | |
| 3,891,140 | 6/1975 | Ayres . | |
| 3,980,227 | 9/1976 | Witty et al. . | |
| 4,278,437 | 7/1981 | Haggar | 436/165 |
| 4,295,601 | 10/1981 | Cowell . | |
| 4,683,120 | 7/1987 | Meserol et al. | 422/72 |
| 5,019,243 | 5/1991 | McEwen et al. | 210/94 |
| 5,253,551 | 10/1993 | DeVaughn | 81/3.09 |
| 5,310,527 | 5/1994 | Romanauskas et al. | 422/102 |
| 5,456,652 | 10/1995 | Eberle . | |
| 5,527,257 | 6/1996 | Piramoon . | |
| 5,538,493 | 7/1996 | Gerken et al. | 494/16 |
| 5,720,406 | 2/1998 | Fassbind et al. | 220/23.4 |

*Primary Examiner*—W. L. Walker
*Assistant Examiner*—Terry K. Cecil
*Attorney, Agent, or Firm*—Shoemaker and Mattare, Ltd.

[57] ABSTRACT

A pliable centrifuge tube array includes a number of tubes having collars which are interconnected by flexible tethers that permit the tubes to diverge when they are placed into holes in a centrifuge rotor. The tubes have a noncircular cross section providing grooves or apexes in which pellets of dense material preferentially collect. In some embodiments, the tethers or tubes have a latching mechanism such as mating projections and sockets which, when engaged, hold the tubes together in close array. The tubes may have individual lids which can be opened and closed simultaneously with a prying tool specially designed for the purpose.

9 Claims, 8 Drawing Sheets

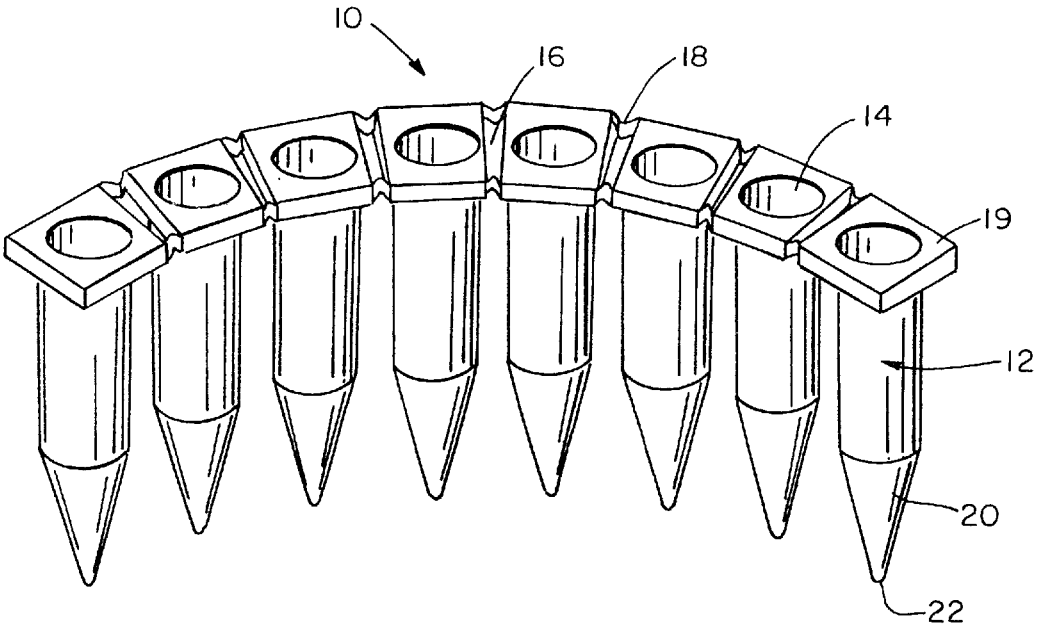
FIG. 1
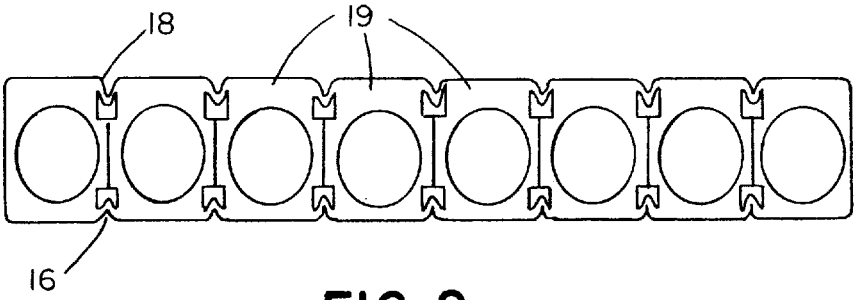
FIG. 2
FIG. 3
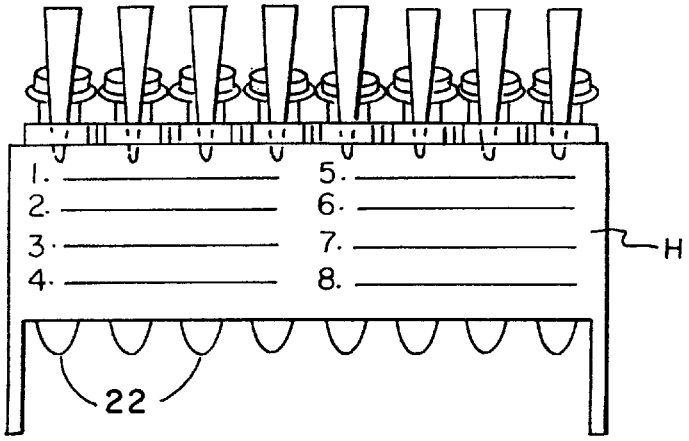

FIG. 4
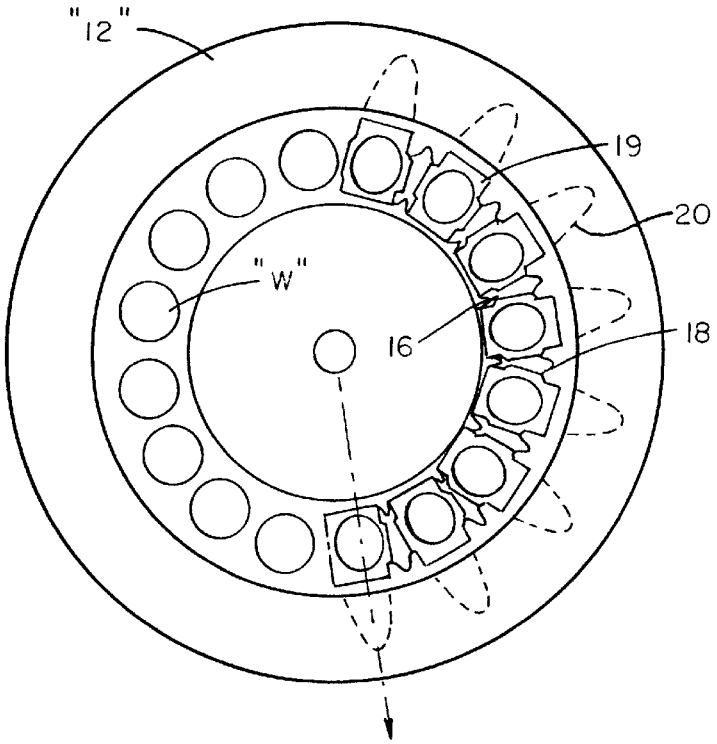
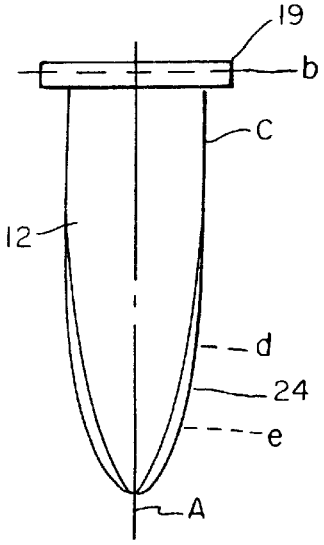
FIG. 5a
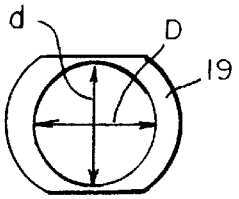
FIG. 5b
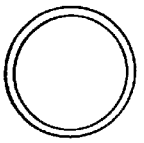
FIG. 5c
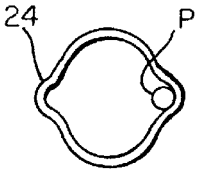
FIG. 5d
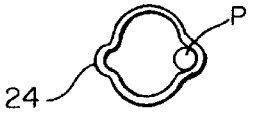
FIG. 5e
FIG. 6
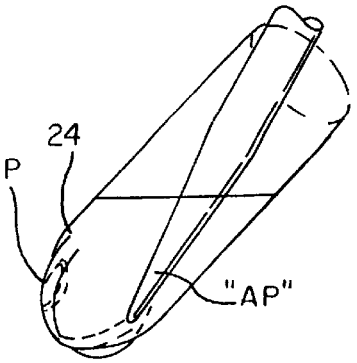

FIG. 15a
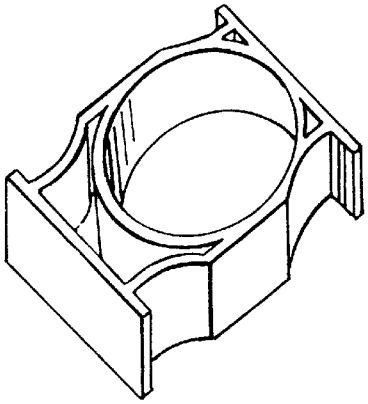
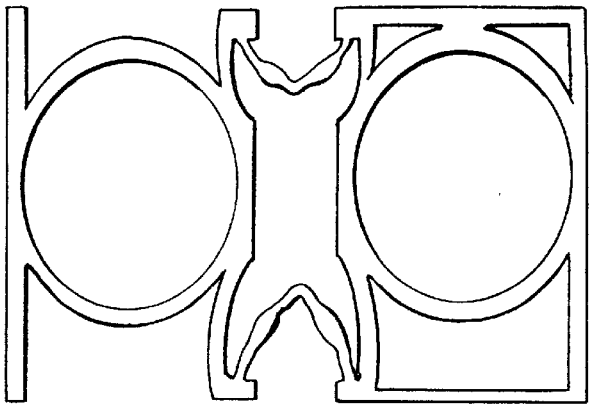
FIG. 15b
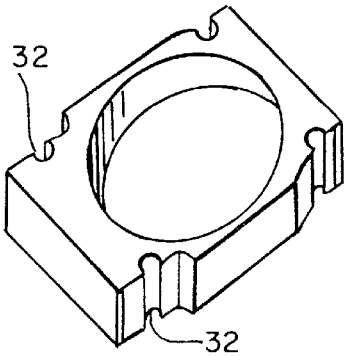
FIG. 16a
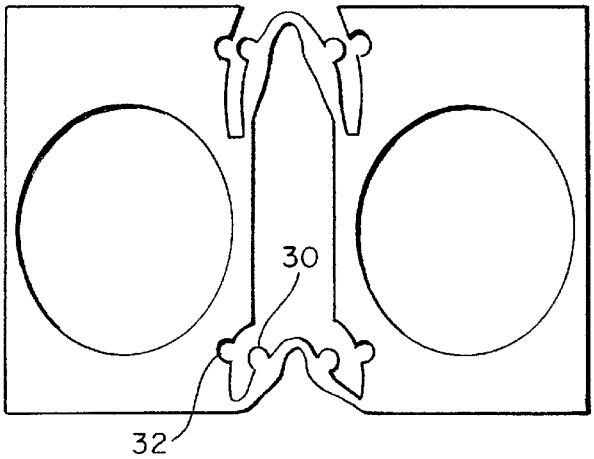
FIG. 16b
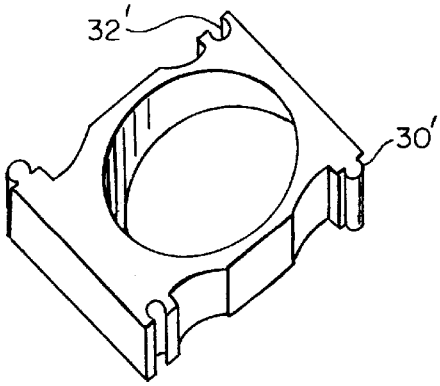
FIG. 17a
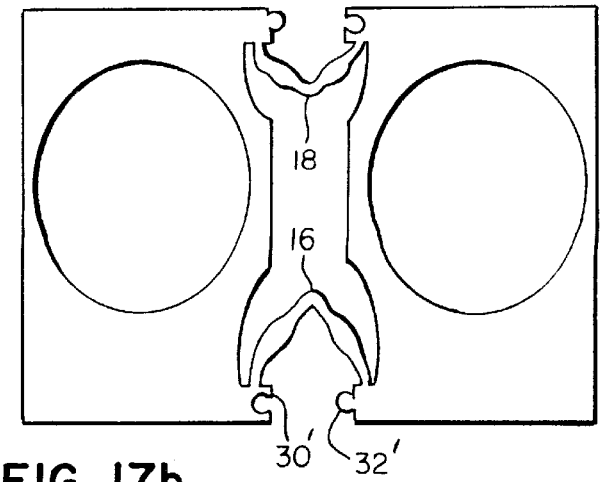
FIG. 17b

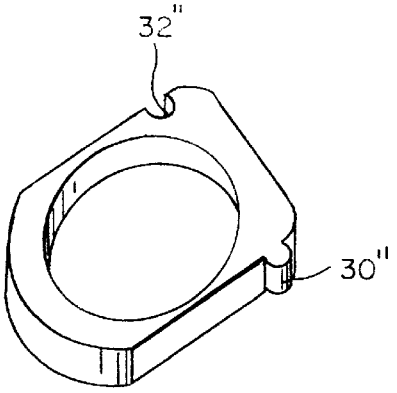
FIG. 18a
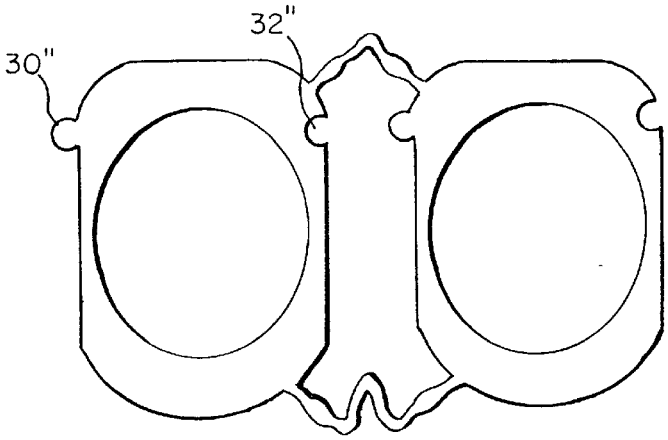
FIG. 18b
FIG. 19b
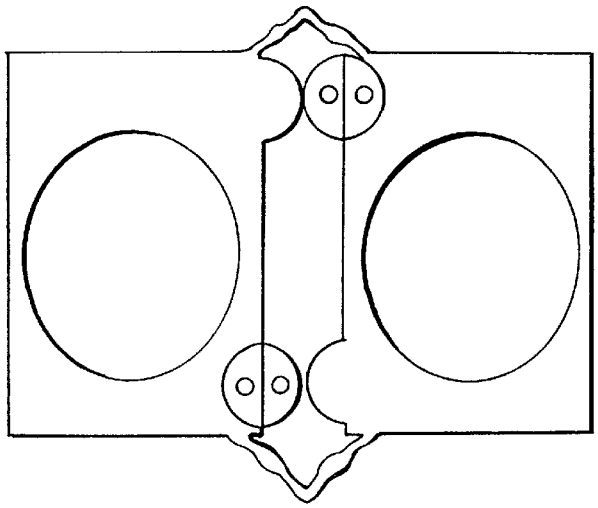
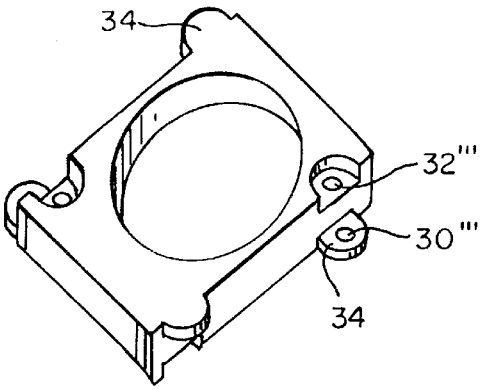
FIG. 19a
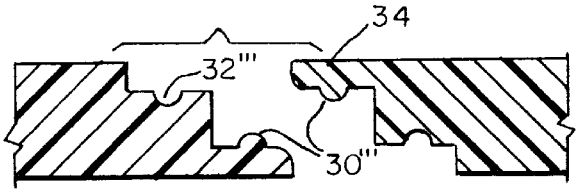
FIG. 19c
FIG. 19d
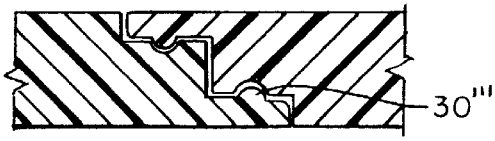

PLIABLE CENTRIFUGE TUBE ARRAY

Reference is made to U. S. Provisional Patent Application No. 60,028,283, filed Oct. 11, 1996.

BACKGROUND OF THE INVENTION

This invention relates to the arts of medicine and chemistry and more particularly to a pliable centrifuge tube array.

A centrifuge is a device used to separate constituents of a sample according to density by generating artificial high "gravity" using centrifugal force. A typical centrifuge has a rotor which is spun at high speed by a motor. The rotor has recesses or slots ("wells") for receiving tubes containing samples to be separated. In rotors where the wells angle downward and outward, the dense material settles out toward one the side of the tube, near the bottom, forming what is known as a "pellet". It is best that the pellet be to one side, so that an aspirating pipette inserted along the opposite side will be sure to avoid interfering with the pellet.

Many current laboratory procedures involve repetitive centrifugation and resuspension in solution of individual samples of cells or extracts of cells: DNA, RNA, proteins, lipids, etc. The samples are spun in a centrifuge, then the supernatant liquid is aspirated off the pellet, another solution is added to the tubes, and the samples are spun again. This procedure may be repeated several times.

To improve processing speed, linear arrays of plastic tubes have been molded with the tubes interconnected along their sides. The axes of the tubes in such an array are parallel. Such tube arrays are convenient to handle, and by providing a constant predetermined centerline spacing, work well with automatic tube filling and sampling equipment such as multi-channel pipettes.

Parallel tube arrays have the problem that, when they are placed in a centrifuge, only one of the tubes can be located in a radial plane of the rotor. For any tube not in a radial plane, the "downward" direction in which the heavy constituents move is toward one side of the tube. Thus, the pellets of dense material which develop in such tubes wind up at various spots on the sides of the tubes. That is, the pellets are splayed away from each other in their location. The variation in pellet location makes it difficult to avoid consistently the pellets when aspirating liquid from the tubes. This problem is worse in an automated system where the pellet must be located by referring to a landmark on the tube.

In order for each tube to lie, properly, in a radial plane of the centrifuge rotor, and to get consistent pellet placement, the tubes must be able to diverge or splay outward.

Another disadvantage of conventional micro-centrifuge tube is that it has only a small outer surface on which the tube may be marked. Typically, the experimenter applies a number, and matches that number to a description in a notebook. This system is cumbersome: sometimes there is confusion as to what experiment the number refers to, especially after the tubes have been in storage for a while. It would be better to maintain tubes in united arrays which could be identified as a unit, and to provide a tube rack which could be marked upon as well.

SUMMARY OF THE INVENTION

An object of the invention is to provide a centrifuge tube array which allows the tubes to be parallel while they are in a piece of stationary equipment such as a rack so that they can be filled in unison with a multi-channel pipette, but also allows them to splay outward when they later are placed in a centrifuge.

Another object is to provide a tube array which allows for different center-to-center spacing between adjacent holes in a centrifuge rotor or tube holder, so that the array can be used in a variety of bench-top centrifuges.

Another object is to allow an array of tubes to be capped and uncapped simultaneously.

A further object is to provide a tube geometry that facilitates avoiding the pellet in the tube when supernatant liquid is being removed with an aspirating pipette.

These and other objects are attained by a pliable centrifuge tube array comprising a plurality of tubes having open tops and closed, tapered bottoms, for holding samples of material to be separated in a centrifuge, and flexible tethers interconnecting the tubes. By the term "flexible" we mean structure, not necessarily elastic, which permits relative movement, not excluding hinged rigid links. The tethers permit the tubes to be parallel to one another in a stationary holder and also to diverge from one another in a centrifuge. Preferably, the tethers have corrugations providing high extensibility so that the tubes can move toward and away from one another to adapt to holders of different types.

The tethers may be associated with complementary projections and sockets that snap together for latching neighboring tubes together, yet permitting disengagement when a stretching force is applied to the array.

While the tethering concept in its broadest sense could be used with tubes having a rimless mouth, and while the tethers could join to the tubes at a point below the mouth, we prefer to provide each tube with a collar at its mouth. In the embodiments illustrated, the upper surface of the collar is flat. Also, in each embodiment shown, the tethers are molded with and to the collars, and the tethers are as wide as the collars.

The tethers have to be flexible for the invention to work: the degree of flexibility is affected by the choice of tether design, and the thickness and material of the tethers. Polypropylene is a presently contemplated material. Some trade-offs between strength and flexibility are involved in this design choice.

The barrels and tips of the preferred micro-tubes have a non-circular cross section—for example, lemon-shaped or polygonal. Such shapes provide grooves, apexes or corners into which pellets of dense material produced by centrifuging will settle. To work properly, at least one groove, apex or corner must lie in the corresponding radial plane of the centrifuge, so that the dense material will gravitate toward the groove. Thus, if the tubes are in a linear array, at least one groove or apex must lie in transverse plane perpendicular to a plane containing the axes of the tubes in the array.

Each tube in the array may have a hinged lid with a protruding tab. In that case, all the tabs are aligned in the same direction from their respective tubes, so that a tool having a common slot engageable with the tabs can be used to open and close the lids in unison.

BRIEF DESCRIPTION OF THE DRAWINGS

In the accompanying drawings,

FIG. 1 is an isometric view of a pliable centrifuge tube array embodying the invention;

FIG. 2 is a top plan view thereof;

FIG. 3 is a front elevation of a stationary tube holder supporting the tube array while the tubes are filled with a multi-channel pipette;

FIG. 4 is a top view of a centrifuge rotor, shown with half of its holes occupied by an array of tubes;

FIG. 5*a* is a side elevation of a single tube having a non-circular cross section; FIGS. 5*b*–5*e* are cross-sections taken on the lines b,c,d and e, respectively;

FIG. 6 is a perspective view of the tip of the tube shown in FIG. 5;

FIGS. 15*a* & 15*b*, 16*a* & 16*b*, 17*a* & 17*b*, 18*a* & 18*b*, and 19*a* & 19*b* show, respectively, five alternative forms of the collars at the tops of the tubes, all of which (except 15*a* and 15*b*) provide for latching the tube array in its compressed state. FIGS. 19*c* and 19*d* are sectional views taken on the line 19*c* in FIG. 19*b*, showing the position of the parts when the array is expanded, and compressed, respectively.

DESCRIPTION OF THE PREFERRED EMBODIMENT

Figure 7A:
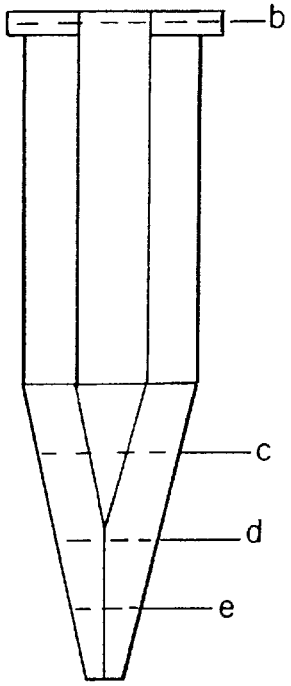
FIGS. 7*a*–7*e* are views like those of FIGS. 5*a*–5*e*, showing an alternative form of the tube.
Figure 7B:
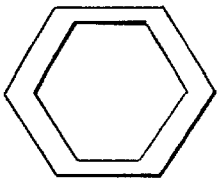
Figure 7C:
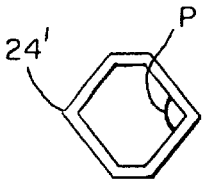
Figure 7D:
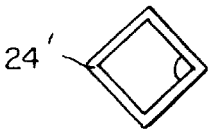
Figure 7E:
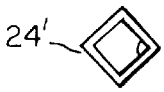
Figure 8:
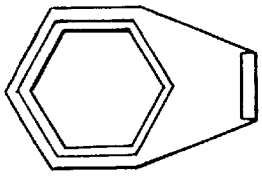
FIG. 8 is a bottom view of a lid designed for the tube of FIG. 7*a;*
Figure 9A:
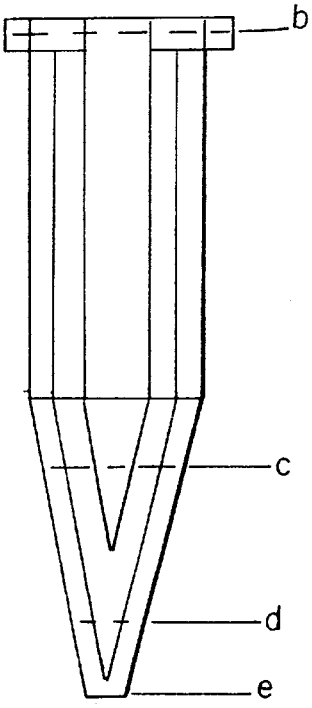
FIGS. 9*a*–9*e* are views like those of FIGS. 9*a*–9*e*, showing another modified form of the tube.
Figure 9B:
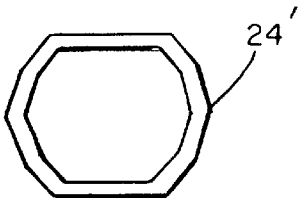
Figure 9D:
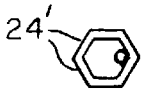
Figure 9E:
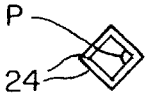
Figure 9C:
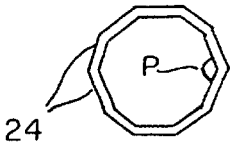
Figure 10:
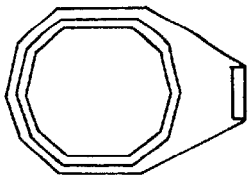
FIG. 10 is a bottom view of a lid designed for the tube of FIG. 9*a;*

A pliable centrifuge tube array 10 embodying the invention is shown in FIGS. 1–2. It comprises a series of tubes 12 interconnected in a series near their mouths 14 by pairs of flexible tethers 16,18 which are molded with the tubes. Preferably, a thickened collar 19 is formed around the mouth of each tube. While paired tethers extending along lines on opposite sides of the tubes are preferred, single tethers or other alternatives may be considered.

Figure 14:
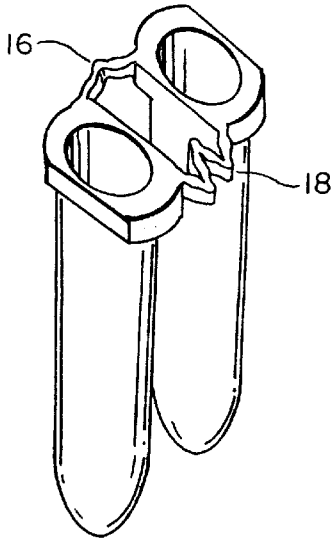
FIG. 14 is an isometric view of a portion of a tube array having links of unequal length.

FIG. 2 shows the array compressed, with the square collars 19 at the tops of the tubes touching, so that the array is linear; that is, the axes of the tubes lie in a common plane. FIG. 1 shows the array in its uncompressed, natural state. The fact that the tethers 16 on one side are shorter than those 18 (see the detail of FIG. 14) on the other side gives the array a curved shape. The curvature is designed to be about that of the wells "W" in a typical benchtop centrifuge rotor "R" (FIG. 4), into which the tubes will be inserted. FIG. 4 shows one array actually seated in the rotor. FIG. 3 shows the linear, compressed array seated in a stationary tube holder "H", in a position suitable for filling by a multi-channel pipette, which is represented by eight triangular tips inserted into the mouths of the tubes.

Each tube has a tapered portion 20 terminating at a bottom tip 22. Each tube may be round, but preferably, it has an elliptical cross-section having a major diameter "D" and a minor diameter "d" (FIG. 5*a*). The collars 19 may be square or rectangular, as in FIGS. 1–2, or round with flattened opposing sides, as seen in FIG. 5*b*. The minor diameters or adjacent tubes are aligned, so that the major diameters are each perpendicular to a plane containing all the longitudinal axes "A" (FIG. 5*a*) of the tubes. The tapered portion 20 of each tube may have a corresponding elliptical cross-section, but it is better to provide the tapered portion with a cross-section having shallow grooves or recesses 24 along opposed sides, such as the lemon-shaped tips shown in FIGS. 5*d* and 5*e*. The purpose of the grooves is to provide a predictable location for receiving the pellet of material "P" produced by centrifuging, which pellet may be very small and difficult to locate otherwise. Conversely, the groove on the opposite side of the tube, closer to the center of the centrifuge, provides a safe site for aspiration of liquid. Having the grooves in a known orientation (as the tethers prevent the tubes from rotating relative to one another) makes it easier for technicians or machines to avoid the pellet when removing supernatant liquid with an aspirating pipette "AP" (FIG. 6). Alternative cross-sectional shapes for the tubes are shown in FIGS. 7–10. In each case, the cross-section is a polygon, at least one apex of which is arranged in a plane perpendicular to the length of the array, so that that apex 24' serves a purpose of receiving the pellet, as described above.

Tube Tethers

The flexible tethers 16,18 may have various forms. The tethers are molded integrally with the tubes, for example, by injection molding polypropylene. The tethers are flexible, being substantially longer than they are wide, and preferably, they have accordion folds 26 providing substantial extensibility. FIGS. 11–19 illustrate various geometries for the tethers, as presently contemplated.

Figure 11:
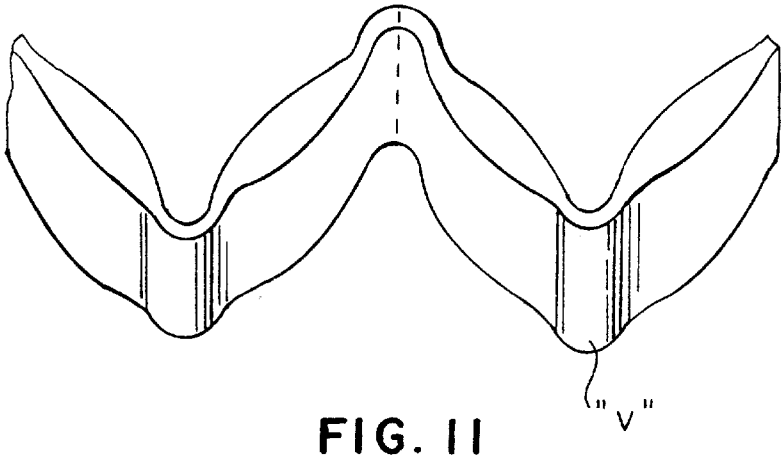
FIGS. 11 and 12 show in details the structure of connecting links which join adjacent tubes of the array.
Figure 12:
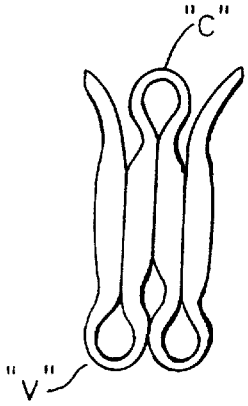

FIGS. 11 and 12 show one preferred tether in detail. This tether has corrugations defined by crests "C" and valleys "V". The material between the crests and valleys is thicker than at the crests and valleys so that, when the tether is compressed (FIG. 12), the crests and valleys do not bind, and substantially all of the bending occurs at the crests and valleys.

Figure 13:
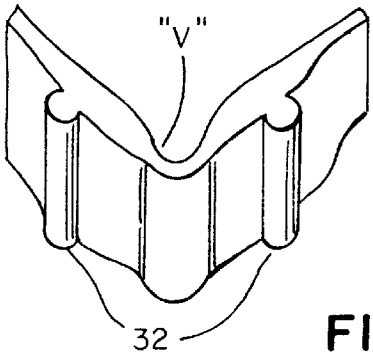
FIG. 13 shows a modified form of the connecting link.

The tether shown in FIG. 13 has projections designed to snap into complementarily-shaped sockets formed in the collars (FIG. 15). In other embodiments, the projections and sockets are both formed on the collars, rather than on the tethers. The projections and sockets face one another so that they snap together when the array is compressed. See the discussion of tube interlocking, below.

Adding tethers to the collars increases their size and the risk that the array may not fit a particular rotor. However, the tethering of the tubes has the advantage of holding sequentially numbered tubes together throughout an experiment, eliminating the need to reorganize the tubes every time they are moved to another piece of equipment. The tethered tube array can be transferred from and inserted into centrifuge rotors, mini-racks, water baths, ice buckets, etc., as a group rather than one by one. The tethers maintain the tubes in the correct orientation in the centrifuge rotor, eliminating the need for inserts.

While horizontal tethers have been described, it should be understood that the tethers could be redesigned so as to loop in a vertical plane between adjacent tubes. This design could be useful where lateral clearance is not available.

Tube Interlocking

In some embodiments (FIGS. 13 and 16–19), the tethers, or the adjacent tube structure, have complementary projections 30 and sockets 32 which when snapped together hold the array in a compressed, and fairly rigid, unified arrangement. The array may be extended, however, by pulling lengthwise upon it with enough force to unsnap the projections from the sockets. Such a latching system is desirable because it allows the experimenter to snap a tethered array together and drop it easily into a tube holder. The latched, linear form is stable and does not require the use of two hands to maintain the linear form for insertion into the holder. In FIG. 16, the latching components 30,32 are on both the tethers and the collars. In FIG. 17, the latching is directly between projections 30' and sockets 32' on adjacent collars, and the tethers are not involved. Likewise, in FIG. 18, where, however, the latching members 30",32" are provided along only one side of the array. In FIG. 19, latching is achieved by the interaction between protuberances 30'" and sockets 32'" in vertically-overlapping ears 34 extending laterally from the collars.

In the embodiment of FIGS. 15*a* and 15*b*, the collar is etched or otherwise perforated to reduce the mass of the collar and thus the time needed for cooling in the injection mold.

Tube Closures

The tube array may be provided (FIGS. 8, 10, 20, 21, 22, and 24) with a molded-in lids 40 for each of the tubes, connected to the tubes by short hinges or straps 42. The lower surface of the lid features a plug 44 which seats within the mouth of the tube, and a tab 46 extends from the free edge of the lid, in a direction away from the hinge. The lower tab is turned downward at 48.

Figure 20:
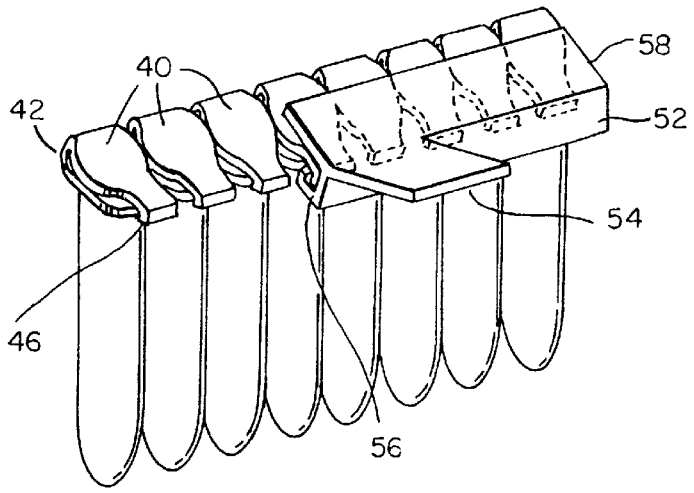
FIG. 20 shows an array of tubes having lids with lifting tabs, and it.
Figure 21:
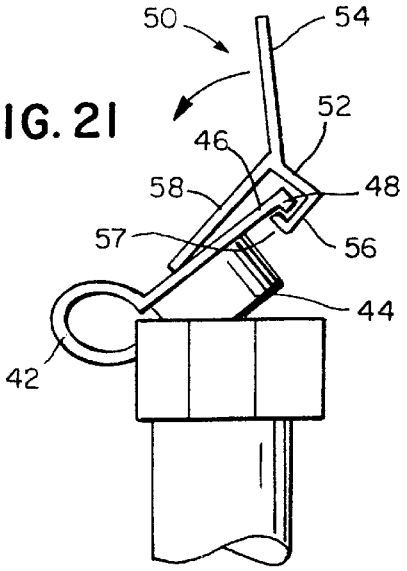
FIG. 21 illustrate a tool for opening the lids in unison.

FIG. 21 shows a special tool 50 positioned over a number of the opening tabs on the lids, for opening the lids in unison. The tool includes a body having a channel 52 sized to receive a number of adjacent lid tabs, and a handle 54 with which one can pry upward on the lids. This illustration of the tool in FIG. 20 is fragmentary—the channel should be long enough to cover all the tabs in the array of tubes. As one can see in FIG. 21, the lower flange 56 of the channel is turned upward at 57 to grasp the tang 48 on the bottom of the tab, and the upper flange 58 is substantially longer, so that it bears against the top of each lid near the hinge.

Figure 22:
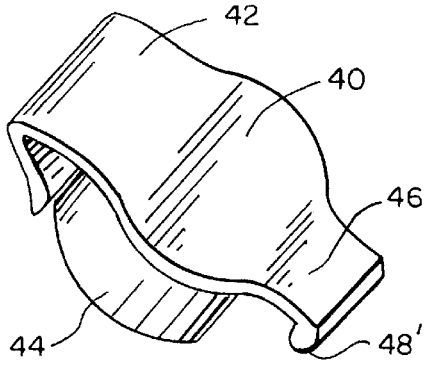
FIG. 22 shows a modified form of the lifting tab.
Figure 23:
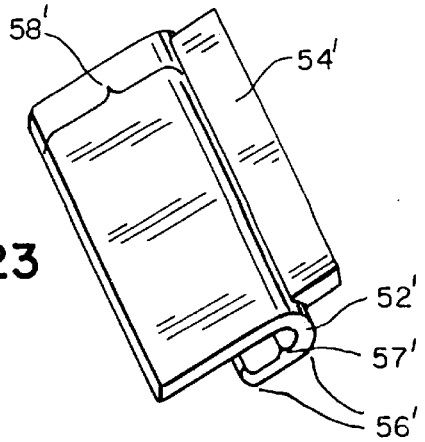
FIGS. 23 and 24 show a tool for both opening and closing the lids.
Figure 24:
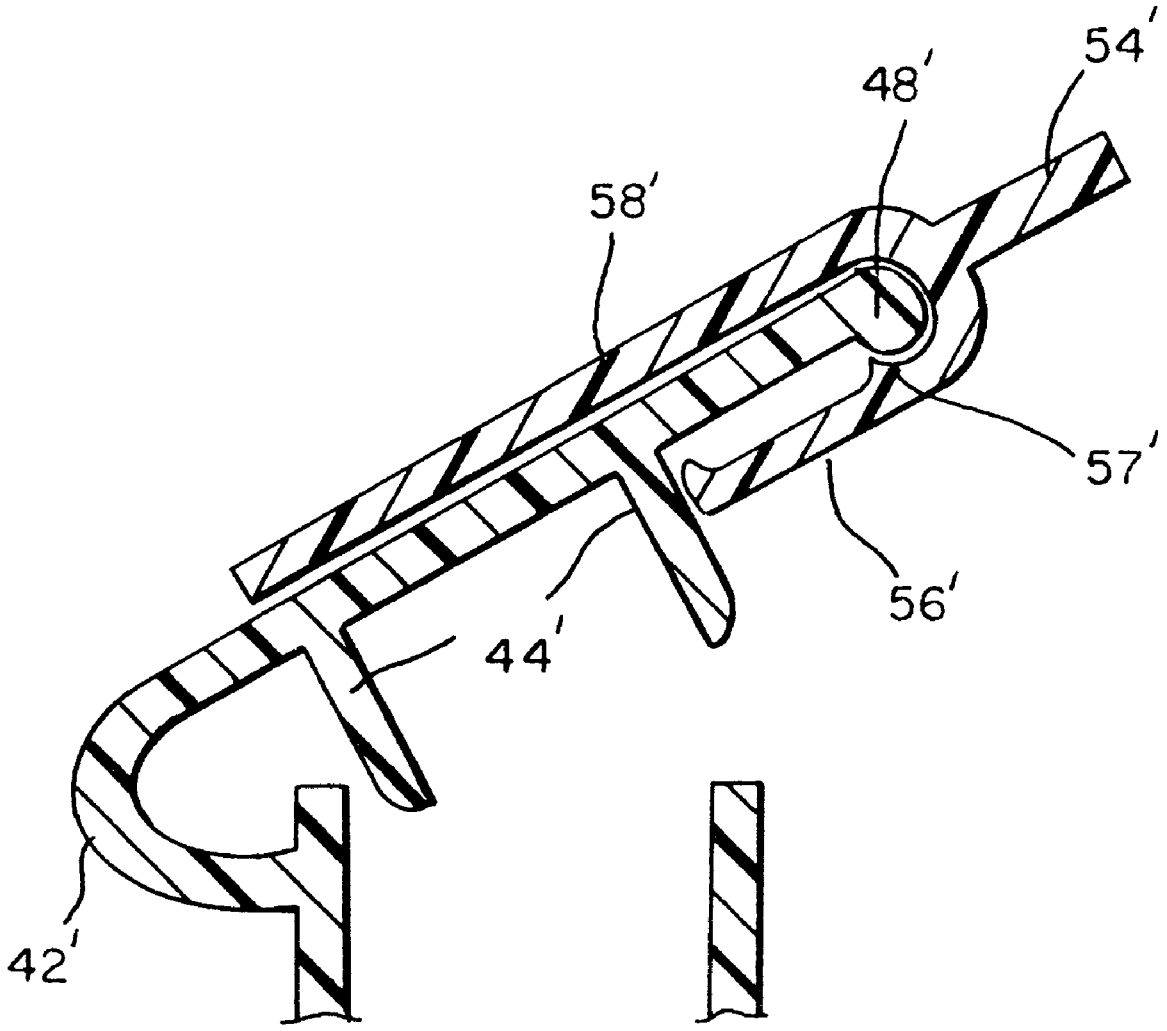

In FIG. 22, the tab has a rounded end. A modified form of the tool appears in FIGS. 23 and 24, designed for the lid shown in FIG. 22. In this case the tool channel fits the tab so closely that it can be used both for opening and closing the lids, and is held captive on the tabs.

The tool can be pushed onto and over the tabs, snapping into place as the rounded end becomes seated in the channel.

Since the invention is subject to modifications and variations, it is intended that the foregoing description and the accompanying drawings shall be interpreted as only illustrative of the invention defined by the following claims.

I claim:

1. A pliable centrifuge tube array comprising a plurality of tubes having open tops and closed bottoms, for holding samples of material to be separated in a centrifuge, flexible tethers interconnecting the tubes in a curvilinear array, said tethers permitting the tubes to be parallel to one another in a stationary holder and also to diverge from one another in a centrifuge, wherein the tethers have corrugations rendering the tethers substantially extendable so that the tubes can move toward and away fiom one another to adapt to holders of different types, said corrugations being defined by crests and valleys, and said tethers having a thickness which is greater between the crests and valleys than at the crests and valleys, so that, when the tether is compressed, substantially all of the bending occurs at the crests and valleys.

2. The invention of claim 1, wherein the tethers are molded integrally with the tubes.

3. The invention of claim 2, wherein the tubes and the tethers are molded from the same material.

4. The invention of claim 1, wherein the tethers are arranged in pairs, extending along lines on opposite sides of the tubes.

5. The invention of claim 4, wherein the tethers on opposite sides of the array are of different lengths, so that the array has a natural semi-circular shape.

6. The invention of claim 1, wherein each tube has a collar formed around its mouth, and the tethers interconnect only the collars of neighboring tubes.

7. A pliable centrifuge tube array comprising a plurality of tubes having open tops and closed bottoms, for holding samples of material to be separated in a centrifuge, flexible tethers interconnecting the tubes in a curvilinear array, said tethers permitting the tubes to be parallel to one another in a stationary holder and also to diverge from one another in a centrifuge, and further comprising projections on said tethers and sockets on neighboring tubes for interconnecting with said projections and latching the tubes together, yet permitting disengagement when a stretching force is applied to the array.

8. The invention of claim 7, wherein each tube has a collar formed around its mouth, and the sockets are formed on said collar.

9. An array of centrifuge tubes wherein each tube has a hinged lid with a protruding tab, all the tabs extending in the same direction from their respective tubes, in combination with a tool having a common channel for engaging plural tubes of the array whereby the lids can be opened and closed in unison with the tool, each of said tabs having a top side and a bottom side, said bottom side having a tang formed therein, said common channel having an upper flange and a lower flange, said lower flange having a raised portion extending into said channel for engaging said tang, thus holding the tool captive on the tabs.

* * * * *